US010486771B2

(12) United States Patent
Tian

(10) Patent No.: US 10,486,771 B2
(45) Date of Patent: Nov. 26, 2019

(54) MOTORIZED HYDROFOIL DEVICE

(71) Applicant: YUJET INTERNATIONAL CORPORATION LIMITED, Central (HK)

(72) Inventor: Yu Tian, Hong Kong (HK)

(73) Assignee: YUJET INTERNATIONAL CORPORATION LIMITED, Central (HK)

( * ) Notice: Subject to any disclaimer, the term of this patent is extended or adjusted under 35 U.S.C. 154(b) by 0 days.

(21) Appl. No.: 15/807,509

(22) Filed: Nov. 8, 2017

(65) Prior Publication Data

US 2019/0135378 A1 May 9, 2019

(51) Int. Cl.

| | |
|---|---|
| ***B63B 1/28*** | (2006.01) |
| ***B63B 1/24*** | (2006.01) |
| ***B63B 1/26*** | (2006.01) |

(52) U.S. Cl.

CPC ..... *B63B 1/286* (2013.01); *B63B 1/246* (2013.01); *B63B 1/248* (2013.01); *B63B 1/26* (2013.01); *B63B 1/283* (2013.01)

(58) Field of Classification Search

CPC .. B63B 1/286; B63B 35/7923; B63B 35/7943
See application file for complete search history.

(56) References Cited

U.S. PATENT DOCUMENTS

| | | | | |
|---|---|---|---|---|
| 3,405,677 | A * | 10/1968 | Smith | B63B 35/7943 114/55.53 |
| 4,517,912 | A * | 5/1985 | Jones | B63B 1/30 114/275 |
| 5,309,859 | A * | 5/1994 | Miller | B63B 35/7923 114/274 |
| 6,178,905 | B1 * | 1/2001 | Dynes | B63B 1/285 114/55.54 |
| 6,183,333 | B1 * | 2/2001 | Hall | A63H 13/045 114/144 A |
| 6,409,560 | B1 * | 6/2002 | Austin | B63B 35/7943 440/6 |
| 7,047,901 | B2 * | 5/2006 | Chen | B63B 1/246 114/274 |
| 8,636,552 | B2 * | 1/2014 | Braden | B63H 21/17 440/6 |
| 8,702,458 | B2 * | 4/2014 | Preston | B63B 35/7943 114/55.56 |
| 8,870,614 | B2 * | 10/2014 | Railey | B63B 35/7943 440/6 |
| 9,359,044 | B2 * | 6/2016 | Langelaan | B63H 21/17 |
| 9,586,659 | B2 * | 3/2017 | Langelaan | B63H 21/17 |
| 9,789,935 | B1 * | 10/2017 | Aguera | B63B 1/26 |

(Continued)

*Primary Examiner* — Lars A Olson
*Assistant Examiner* — Jovon E Hayes
(74) *Attorney, Agent, or Firm* — WPAT, P.C., Intellectual Property Attorneys; Anthony King

(57) ABSTRACT

A motorized hydrofoil apparatus may include a sailboard having a top surface and a bottom surface; a first hydrofoil assembly; a pivotable second hydrofoil attached to a second support unit; and a propulsion system. The hydrofoil apparatus may also include one or more sensing units disposed on predetermined locations on the first support unit to operatively communicate to the second hydrofoil to automatically generate corrective responses to various destabilizing hydrodynamic effects to stabilize the hydrofoil apparatus.

14 Claims, 18 Drawing Sheets

(56) References Cited

U.S. PATENT DOCUMENTS

| | | | | |
|---|---|---|---|---|
| 2003/0167991 | A1* | 9/2003 | Namanny | B63B 35/7926<br>114/55.56 |
| 2013/0059489 | A1* | 3/2013 | Vlock | B63B 7/085<br>440/6 |
| 2015/0104985 | A1* | 4/2015 | Langelaan | B63H 21/17<br>440/6 |
| 2017/0283015 | A1* | 10/2017 | Langelaan | B63H 21/17 |
| 2017/0349246 | A1* | 12/2017 | Tian | B63B 35/7943 |
| 2018/0072383 | A1* | 3/2018 | Montague | B63B 1/246 |

* cited by examiner

MOTORIZED HYDROFOIL DEVICE

FIELD OF THE INVENTION

The present invention relates to a motorized hydrofoil device, and in particular to a motorized hydrofoil device with a plurality of actuating units to generate automatic corrective movement to increase stability thereof.

BACKGROUND OF THE INVENTION

Personal water craft (PWC) vehicles, including hydrofoil devices, have enjoyed immense popularity in recent years. PWCs generally allow one, two or more riders to sit, kneel or stand on the craft and to ride across the surface of a body of water. The popularity of PWCs is also attributable to the considerations that they are less expensive than traditional power boats, are more easily transported over land by smaller trailers, and storage and maintenance of the PWCs is generally simpler than with full size power boats.

Hydrofoils are appended to sailboards for the purpose of increasing speed or improving handling characteristics, or both. Higher speed comes essentially for free, since submerged hydrofoils can easily provide adequate lift while operating at much lower drag than planning hulls. The problem in the design of hydrofoil sailboards is that of providing rapid automatic corrective response to a number of destabilizing hydrodynamic effects, so that the sailor is able to control the craft.

U.S. Pat. No. 4,517,912 to Jones discloses a control means for hydrofoils for a sailing catamaran in which the attitude of a main foil is to be controlled by the depth of submersion of a smaller sensing foil, in consequence of which, the depth of the main foil, and hence the height of the craft itself, are kept constant. Jones states that his sensing foil should track at a small depth below the surface based on the analysis on the incorrect equilibrium depth expectation However, Jones does not teach or disclose anything related how to automatically generate corrective response to a number of destabilizing hydrodynamic effects to enable the sailor to control the hydrofoil.

U.S. Pat. No. 4,579,076 to Chaumette discloses a mechanism similar to Jones for automatic height regulation of individual hydrofoil elements. In both devices, because of the short horizontal distance between the sensing foil and the foil it controls, control will tend to be abrupt. This abruptness will become especially acute in waves.

Therefore, there remains a need for a new and improved motorized hydrofoil device with automatic stability control to generate corrective response to various destabilizing hydrodynamic effects to increase the stability of the hydrofoil device.

SUMMARY OF THE INVENTION

It is an object of the present invention to provide a motorized hydrofoil device to automatically generate corrective responses to various destabilizing hydrodynamic effects to stabilize the hydrofoil device.

It is another object of the present invention to provide a motorized hydrofoil device having one or more sensing units to operatively communicate with a plurality of movable actuating units to generate corrective movement to various destabilizing hydrodynamic effects.

It is a further object of the present invention to a motorized hydrofoil device to have an inertial measurement unit (IMU) for a close-loop attitude control.

In one aspect, a hydrofoil device may include a sailboard having a top surface and a bottom surface; a first hydrofoil assembly having a first hydrofoil and a first support unit; a second hydrofoil assembly having a second support unit and a second hydrofoil; and a propulsion system. In one embodiment, one end of the first support unit is attached to a predetermined location at the bottom surface of the sailboard between a centre portion and a rear end of the sailboard; and the other end of the first support unit is attached to nearly a centre portion of the first hydrofoil. Furthermore, the second support unit extends from a front end of the first hydrofoil toward a front end of the sailboard and is connected to the second hydrofoil near the front end of the sailboard. The propulsion system is configured to provide power for the hydrofoil device. In one embodiment, the propulsion system is disposed between the first actuating units discussed below. In a further embodiment, the hydrofoil device may include one or more sensing units disposed on predetermined locations on first supporting unit of the first hydrofoil assembly.

In an exemplary embodiment, the first hydrofoil assembly has a pair of first actuating units hingedly located on a trailing edge on both sides of the first hydrofoil. Similar to ailerons on each wing of the airplane to control the airplane's roll movement, namely movement around the airplane's longitudinal axis, the first actuating units of the first hydrofoil assembly are configured to stabilize the hydrofoil device around its longitudinal axis, or roll axis. The first actuating units may operatively communicate with the sensing unit through a control unit, so when a deviation of the hydrofoil device around its longitudinal axis is detected by the sensing unit, a deviation signal will be transmitted to the control unit that is configured to control the movement of the first actuating units to correct the deviation. For example, when the sensing unit detects a deviation that may cause the hydrofoil device to roll in a counterclockwise manner, a deviation signal can be transmitted to the control unit, which is configured to trigger the first actuating units to make appropriate corrective movement to stabilize the hydrofoil device.

More specifically, when the control unit receives the deviation signal regarding deviation from the sensing unit, one of the first actuating units is triggered by the control unit to move up while the other first actuating unit is triggered to move down to generate a corrective clockwise torque with the corrective movement to eliminate the effect generated by counterclockwise deviation to further stabilize the hydrofoil.

Likewise, when the sensing unit detects a deviation that may cause the hydrofoil device to roll in a clockwise manner, another deviation signal can be transmitted to the control unit to trigger the first actuating units to make appropriate corrective movement to stabilize the hydrofoil device. More specifically, when the control unit receives the deviation signal regarding deviation from the sensing unit, one of the actuating unit is triggered to move down while the actuating unit is moving up to generate a corrective counterclockwise torque with the corrective movement to eliminate the effect generated by clockwise deviation to further stabilize the hydrofoil.

In addition to the first hydrofoil assembly, the second hydrofoil assembly can also generate corrective movement to eliminate deviation of the hydrofoil device around its lateral axis. Similar to elevators hingedly located on both sides of the tailplane to control the airplane's pitch, namely increasing or decreasing the lift generated by the wings when it pitches the airplane's nose up or down by increasing or decreasing the angle of attack, the second actuating units of the second hydrofoil assembly are configured to stabilize the hydrofoil device around its lateral axis, or pitch axis.

In another embodiment, the second actuating units may also operatively communicate with the sensing unit, so when a deviation of the hydrofoil device around its lateral axis is detected by the sensing unit, a deviation signal will be first transmitted to the control unit, which will then trigger the second actuating units to correct the deviation. For example, when the sensing unit detects a deviation that may cause the hydrofoil device to pitch up from the front end thereof, a deviation signal can be transmitted to the control unit to trigger the second actuating units to make appropriate corrective movement to stabilize the hydrofoil device.

More specifically, when the control unit receives the deviation signal regarding deviation from the sensing unit, both the second actuating units are triggered to move up to generate a corrective torque with the corrective movement to eliminate the effect of deviation to further stabilize the hydrofoil.

Likewise, when the sensing unit detects a deviation that may cause the hydrofoil device to pitch down from the front end thereof, another deviation signal can be transmitted to the control unit to trigger the second actuating units to make appropriate corrective movement to stabilize the hydrofoil device. More specifically, both the second actuating units will be triggered by the control unit to move down to generate a corrective torque with the corrective movement to eliminate the effect generated by clockwise deviation to further stabilize the hydrofoil.

The hydrofoil device may include an inertial measurement unit (IMU) at a predetermined position thereof. It is noted that the IMUs are often incorporated into Inertial Navigation System which utilize the raw IMU measurements to calculate attitude, angular rates, linear velocity and position relative to a global reference frame.

In one embodiment, the user can stand on the top surface of the sailboard to control the hydrofoil device by shifting his/her own centre of gravity (CG). More specifically, the hydrofoil device may include one or more sensing devices to detect the user's centre of gravity or the change thereof to enable the user to control the hydrofoil by steering, accelerating and braking. In another embodiment, the control of the hydrofoil can be done by a hand-held device on the user's hand.

In one embodiment, the user can stand on the top surface of the sailboard to control the hydrofoil device by shifting his/her own centre of gravity (CG). More specifically, the hydrofoil device may include one or more sensing devices to detect the user's centre of gravity or the change thereof to enable the user to control the hydrofoil by steering, accelerating and braking. In another embodiment, the control of the hydrofoil can be done by a hand-held device on the user's hand. In a further embodiment, the user can sit on the sailboard to control the hydrofoil device.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publication s mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

As used in the description herein and throughout the claims that follow, the meaning of "a", "an", and "the" includes reference to the plural unless the context clearly dictates otherwise. Also, as used in the description herein and throughout the claims that follow, the terms "comprise or comprising", "include or including", "have or having", "contain or containing" and the like are to be understood to be open-ended, i.e., to mean including but not limited to. As used in the description herein and throughout the claims that follow, the meaning of "in" includes "in" and "on" unless the context clearly dictates otherwise.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the embodiments. As used herein, the term "and/or" includes any and all combinations of one or more of the associated listed items.

Figure 1:
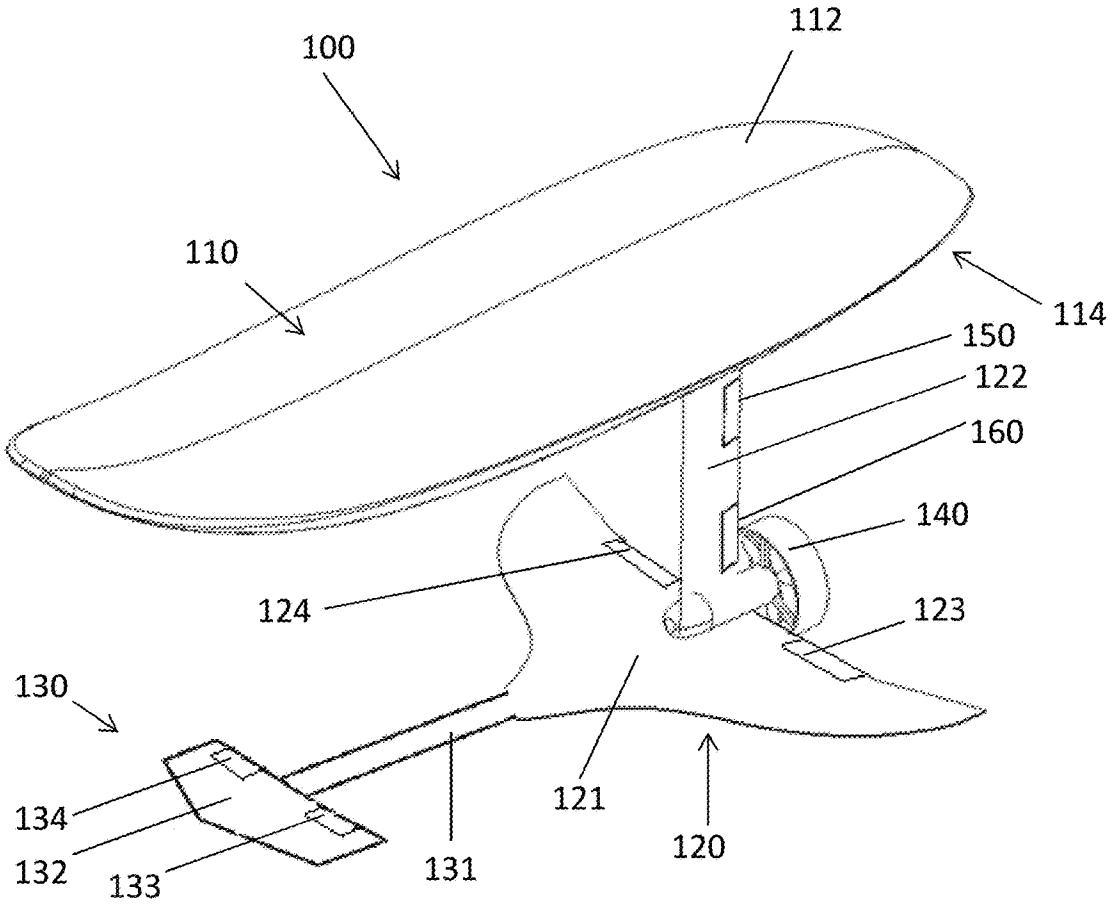
FIG. 1 is a schematic view of one aspect of the motorized hydrofoil device in the present invention.

In one aspect, as shown in FIG. 1, a hydrofoil device 100 may include a sailboard 110 having a top surface 112 and a bottom surface 114; a first hydrofoil assembly 120 having a first hydrofoil 121 and a first support unit 122; a second hydrofoil assembly 130 having a second support unit 131 and a second hydrofoil 132; and a propulsion system 140. In one embodiment, one end of the first support unit 121 is attached to a predetermined location at the bottom surface 114 of the sailboard 110 between a centre portion and a rear end of the sailboard 110; and the other end of the first support unit 122 is attached to nearly a centre portion of the first hydrofoil 121. Furthermore, the second support unit 131 extends from a front end of the first hydrofoil 121 toward a front end of the sailboard 110 and is connected to the second hydrofoil 132 near the front end of the sailboard 110. The propulsion system 140 is configured to provide power for the hydrofoil device 100. In one embodiment, the propulsion system 140 is disposed between the first actuating units (123, 124) discussed below.

As discussed above, while conventional hydrofoil devices may be equipped with some control means, conventional hydrofoil devices cannot automatically control the stability of the hydrofoil devices to generate corrective response to various destabilizing hydrodynamic effects. In a further embodiment, the hydrofoil device 100 may include one or more sensing units 150 disposed on predetermined locations on first supporting unit 122 of the first hydrofoil assembly 120.

Figure 2:
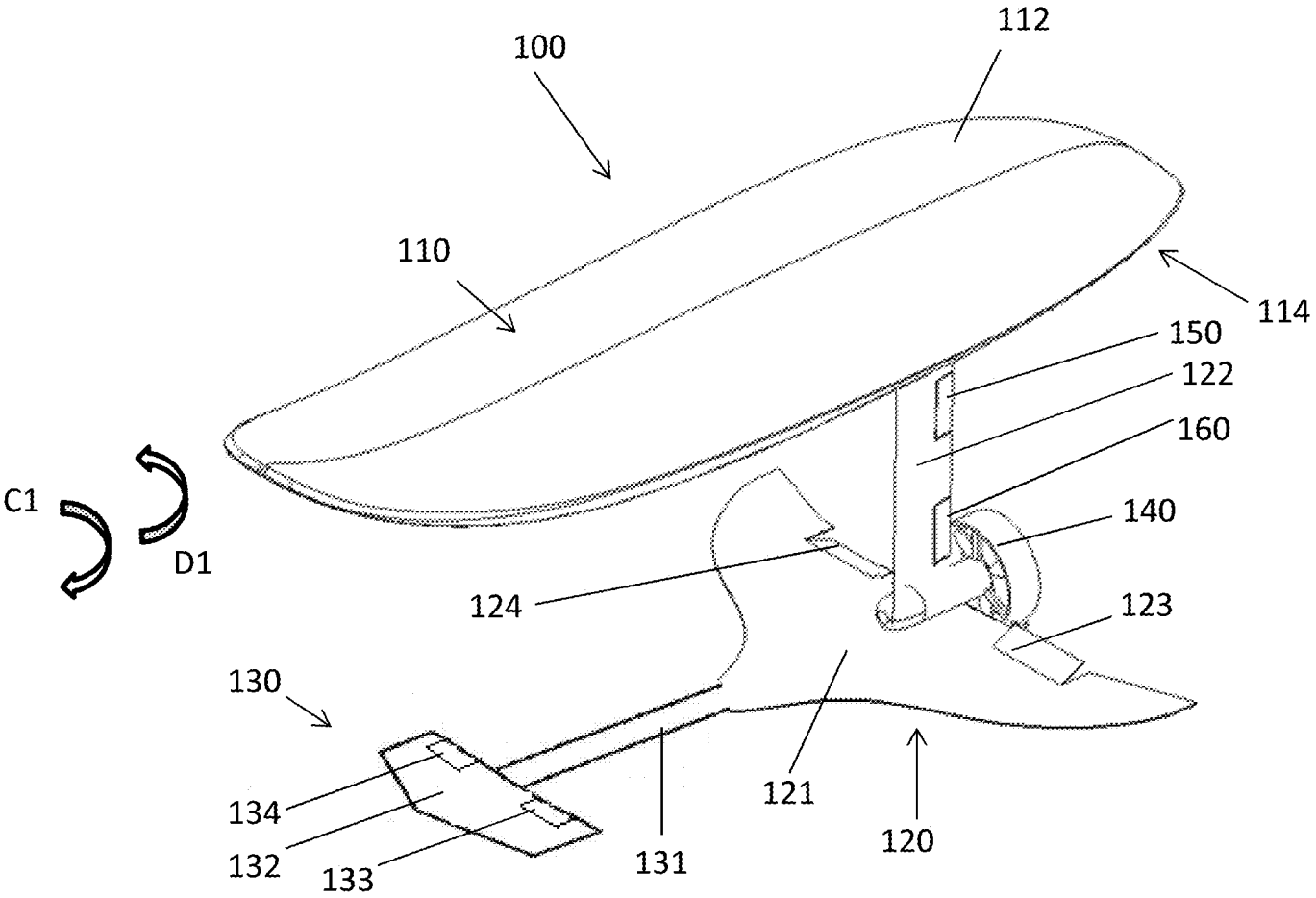
FIG. 2 illustrates a schematic view of the motorized hydrofoil device to generate a corrective movement C1 to eliminate the effect of the deviation D1.

In an exemplary embodiment, the first hydrofoil assembly 120 has a pair of first actuating units (123, 124) hingedly located on a trailing edge on both sides of the first hydrofoil 121. Similar to ailerons on each wing of the airplane to control the airplane's roll movement, namely movement around the airplane's longitudinal axis, the first actuating units (123, 124) of the first hydrofoil assembly 120 are configured to stabilize the hydrofoil device 100 around its longitudinal axis, or roll axis. The first actuating units (123, 124) may operatively communicate with the sensing unit 150 through a control unit 160, so when a deviation of the hydrofoil device 100 around its longitudinal axis is detected by the sensing unit 150, a deviation signal will be transmitted to the control unit 160 that is configured to control the movement of the first actuating units (123, 124) to correct the deviation. For example, as shown in FIG. 2, when the sensing unit 150 detects a deviation D1 that may cause the hydrofoil device 100 to roll in a counterclockwise manner, a deviation signal can be transmitted to the control unit 160, which is configured to trigger the first actuating units (123, 124) to make appropriate corrective movement C1 to stabilize the hydrofoil device 100.

As discussed above, the first actuating units (123, 124) are hingedly located on both sides of the first hydrofoil 121 and each of the first actuating units 123 and 124 can move up or down to control the movement of hydrofoil device 100 around its longitudinal axis. More specifically, when the control unit 160 receives the deviation signal regarding deviation D1 from the sensing unit 150, the actuating unit 123 is triggered by the control unit 160 to move up while the actuating unit 124 is triggered to move down to generate a corrective clockwise torque with the corrective movement C1 to eliminate the effect generated by counterclockwise deviation D1 to further stabilize the hydrofoil 100.

Figure 3:
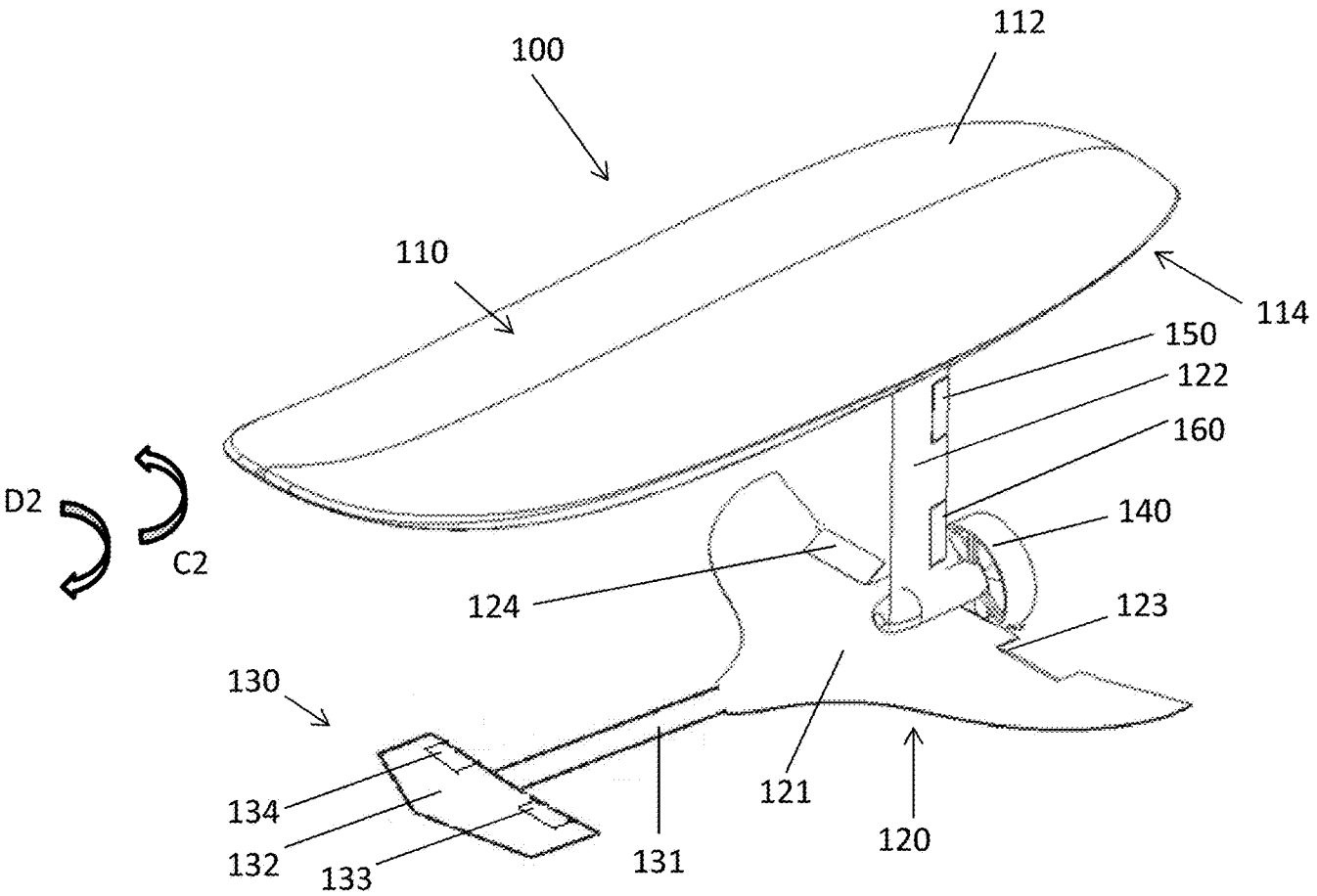
FIG. 3 illustrates a schematic view of the motorized hydrofoil device to generate a corrective movement C2 to eliminate the effect of the deviation D2.

Likewise, as shown in FIG. 3, when the sensing unit 150 detects a deviation D2 that may cause the hydrofoil device 100 to roll in a clockwise manner, another deviation signal can be transmitted to the control unit 160 to trigger the first actuating units (123, 124) to make appropriate corrective movement C2 to stabilize the hydrofoil device 100. More specifically, when the control unit 160 receives the deviation signal regarding deviation D2 from the sensing unit 150, the actuating unit 123 is triggered to move down while the actuating unit 124 is moving up to generate a corrective counterclockwise torque with the corrective movement C2 to eliminate the effect generated by clockwise deviation D2 to further stabilize the hydrofoil 100.

In addition to the first hydrofoil assembly 120, the second hydrofoil assembly 130 can also generate corrective movement to eliminate deviation of the hydrofoil device 100 around its lateral axis. Similar to elevators hingedly located on both sides of the tailplane to control the airplane's pitch, namely increasing or decreasing the lift generated by the wings when it pitches the airplane's nose up or down by increasing or decreasing the angle of attack, the second actuating units (133, 134) of the second hydrofoil assembly 130 are configured to stabilize the hydrofoil device 100 around its lateral axis, or pitch axis.

Figure 4:
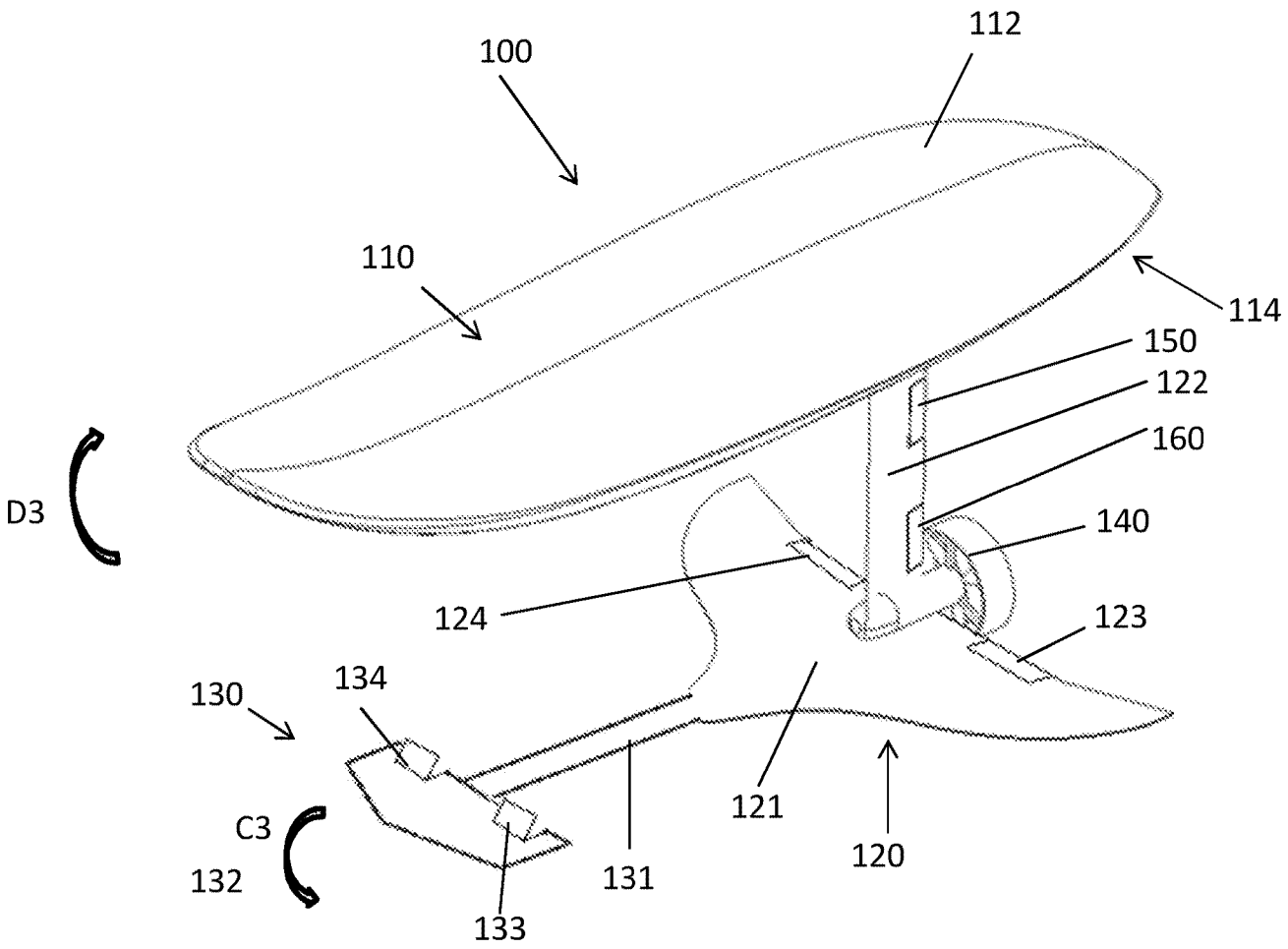
FIG. 4 illustrates a schematic view of the motorized hydrofoil device to generate a corrective movement C3 to eliminate the effect of the deviation D3.

In another embodiment, the second actuating units (133, 134) may also operatively communicate with the sensing unit 150, so when a deviation of the hydrofoil device 100 around its lateral axis is detected by the sensing unit 150, a deviation signal will be first transmitted to the control unit 160, which will then trigger the second actuating units (133, 134) to correct the deviation. For example, as shown in FIG. 4, when the sensing unit 150 detects a deviation D3 that may cause the hydrofoil device 100 to pitch up from the front end thereof, a deviation signal can be transmitted to the control unit 160 to trigger the second actuating units (133, 134) to make appropriate corrective movement C3 to stabilize the hydrofoil device 100.

More specifically, when the control unit 160 receives the deviation signal regarding deviation D3 from the sensing unit 150, both the second actuating units 133 and 134 are triggered to move up to generate a corrective torque with the corrective movement C3 to eliminate the effect of deviation D3 to further stabilize the hydrofoil 100.

Figure 5:
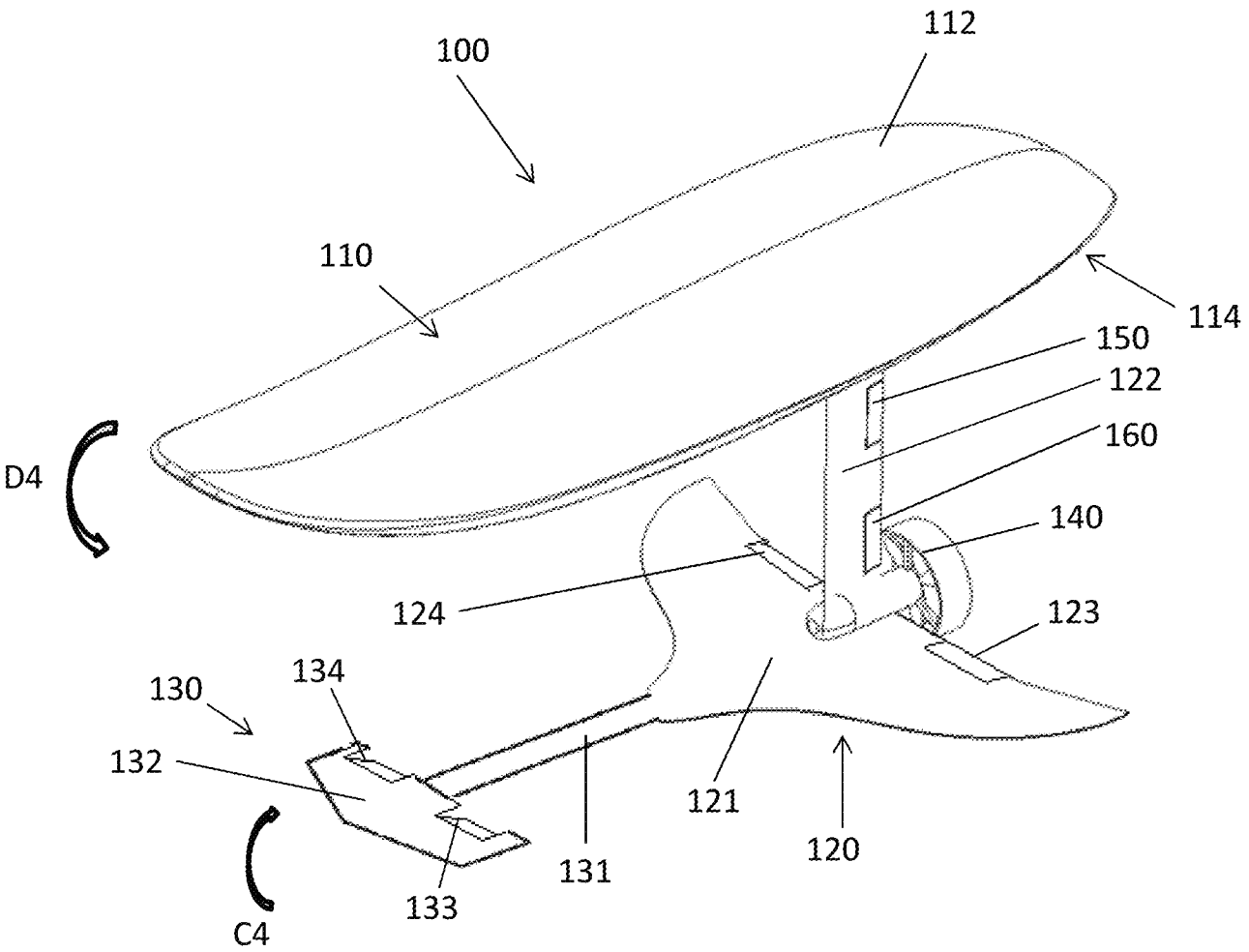
FIG. 5 illustrates a schematic view of the motorized hydrofoil device to generate a corrective movement C4 to eliminate the effect of the deviation D4.

Likewise, as shown in FIG. 5, when the sensing unit 150 detects a deviation D4 that may cause the hydrofoil device 100 to pitch down from the front end thereof, another deviation signal can be transmitted to the control unit 160 to trigger the second actuating units (133, 134) to make appropriate corrective movement C4 to stabilize the hydrofoil device 100. More specifically, the second actuating units 133 and 134 will be triggered by the control unit 160 to move down to generate a corrective torque with the corrective movement C4 to eliminate the effect generated by clockwise deviation D4 to further stabilize the hydrofoil 100.

The hydrofoil device 100 may include an inertial measurement unit (IMU) at a predetermined position thereof. It is noted that the IMUs are often incorporated into Inertial Navigation System which utilize the raw IMU measurements to calculate attitude, angular rates, linear velocity and position relative to a global reference frame.

Figure 6:
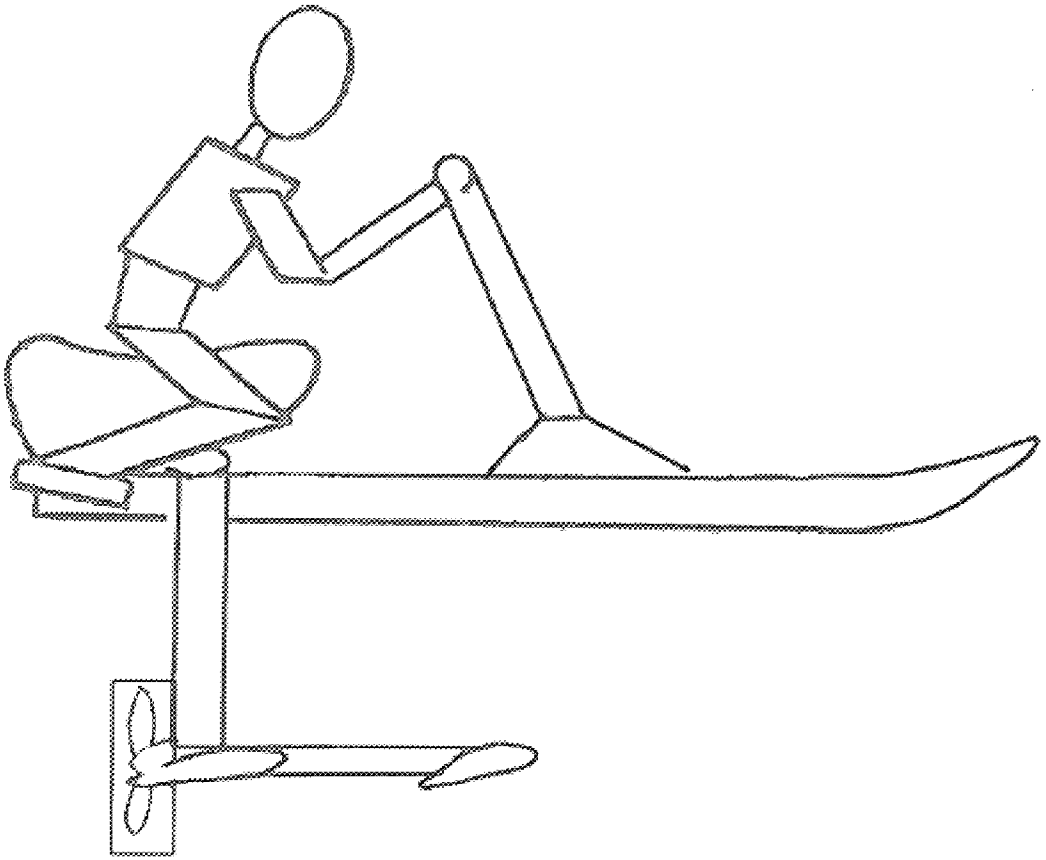
FIG. 6 illustrates a schematic view of the user sitting on the motorized hydrofoil device in the present invention.

In one embodiment, the user can stand on the top surface 112 of the sailboard 110 to control the hydrofoil device 100 by shifting his/her own centre of gravity (CG). More specifically, the hydrofoil device 100 may include one or more sensing devices to detect the user's centre of gravity or the change thereof to enable the user to control the hydrofoil by steering, accelerating and braking. In another embodiment, the control of the hydrofoil can be done by a hand-held device on the user's hand. In a further embodiment, the user can sit on the sailboard to control the hydrofoil device 100 as shown in FIG. 6.

In another aspect, as shown in FIGS. 7 to 10, the second hydrofoil assembly 130' can extend from a rear end of the first hydrofoil 121 of the first hydrofoil assembly 120. Similar to the second hydrofoil assembly 130 extending from the front end of the first hydrofoil 121, the second actuating units (133', 134') hingedly located on the second hydrofoil 132' are configured to stabilize the hydrofoil device 100 around its lateral axis, or pitch axis.

Figure 7:
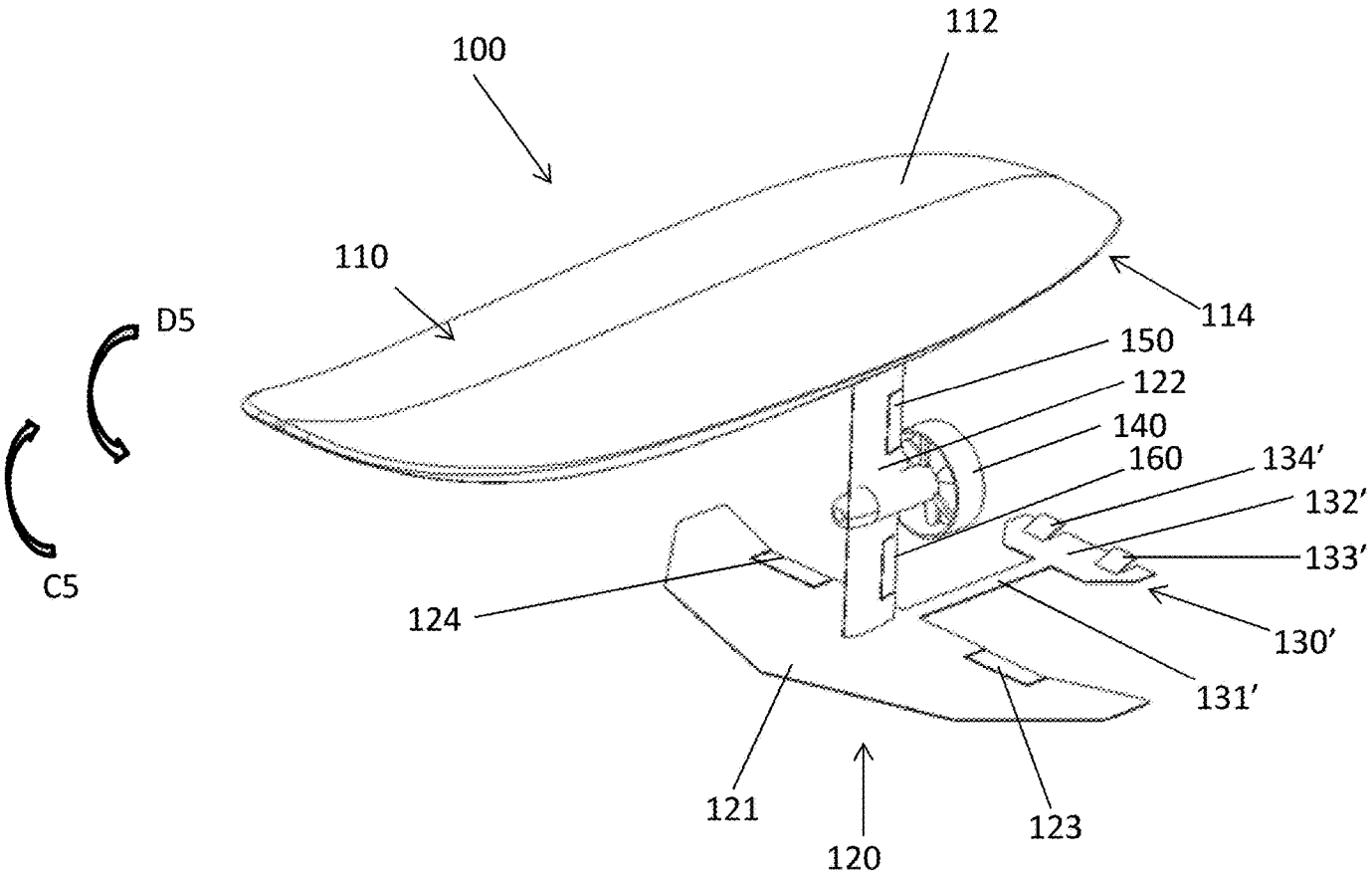
FIG. 7 illustrates a schematic view of another aspect of the motorized hydrofoil device to generate a corrective movement C5 to eliminate the effect of the deviation D5.

For example, as shown in FIG. 7, when the sensing unit 150 detects a deviation D5 that may cause the hydrofoil device 100 to pitch up from the rear end thereof, a deviation signal can be transmitted to the control unit 160 to trigger the second actuating units (133', 134') to make appropriate corrective movement C5 to stabilize the hydrofoil device 100.

More specifically, when the control unit 160 receives the deviation signal regarding deviation D5 from the sensing unit 150, the second actuating units 133' and 134' are triggered to both move up to generate a corrective torque with the corrective movement C5 to eliminate the effect of deviation D5 to further stabilize the hydrofoil 100.

Figure 8:
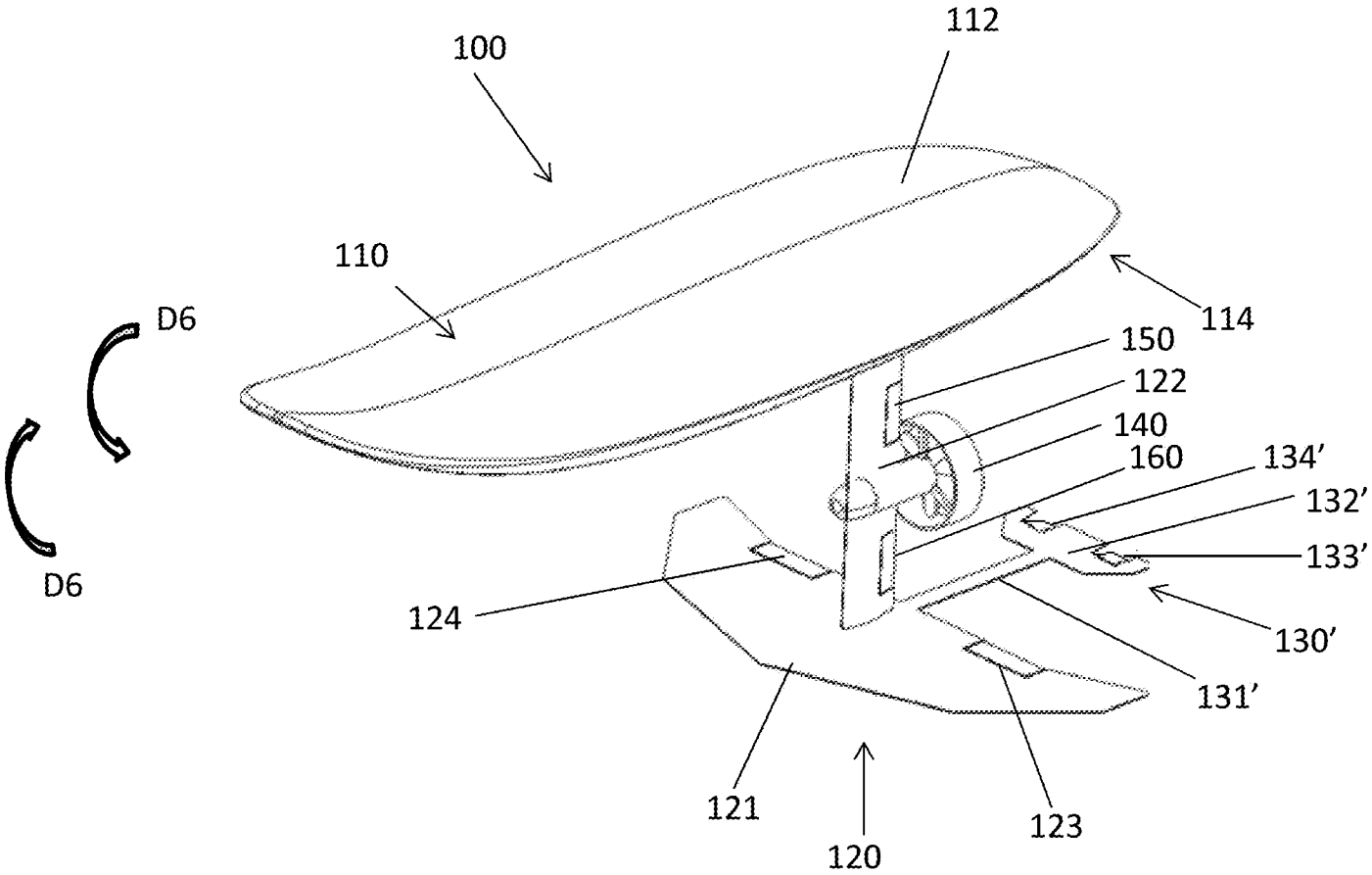
FIG. 8 illustrates a schematic view of another aspect of the motorized hydrofoil device to generate a corrective movement C6 to eliminate the effect of the deviation D6.

Likewise, as shown in FIG. 8, when the sensing unit 150 detects a deviation D6 that may cause the hydrofoil device 100 to pitch down from the rear end thereof, another deviation signal can be transmitted to the control unit 160 to trigger the second actuating units (133', 134') to make appropriate corrective movement C6 to stabilize the hydrofoil device 100. More specifically, the second actuating units 133' and 134' are triggered to move down to generate a corrective torque with the corrective movement C6 to eliminate the effect generated by deviation D6 to further stabilize the hydrofoil 100.

Figure 9:
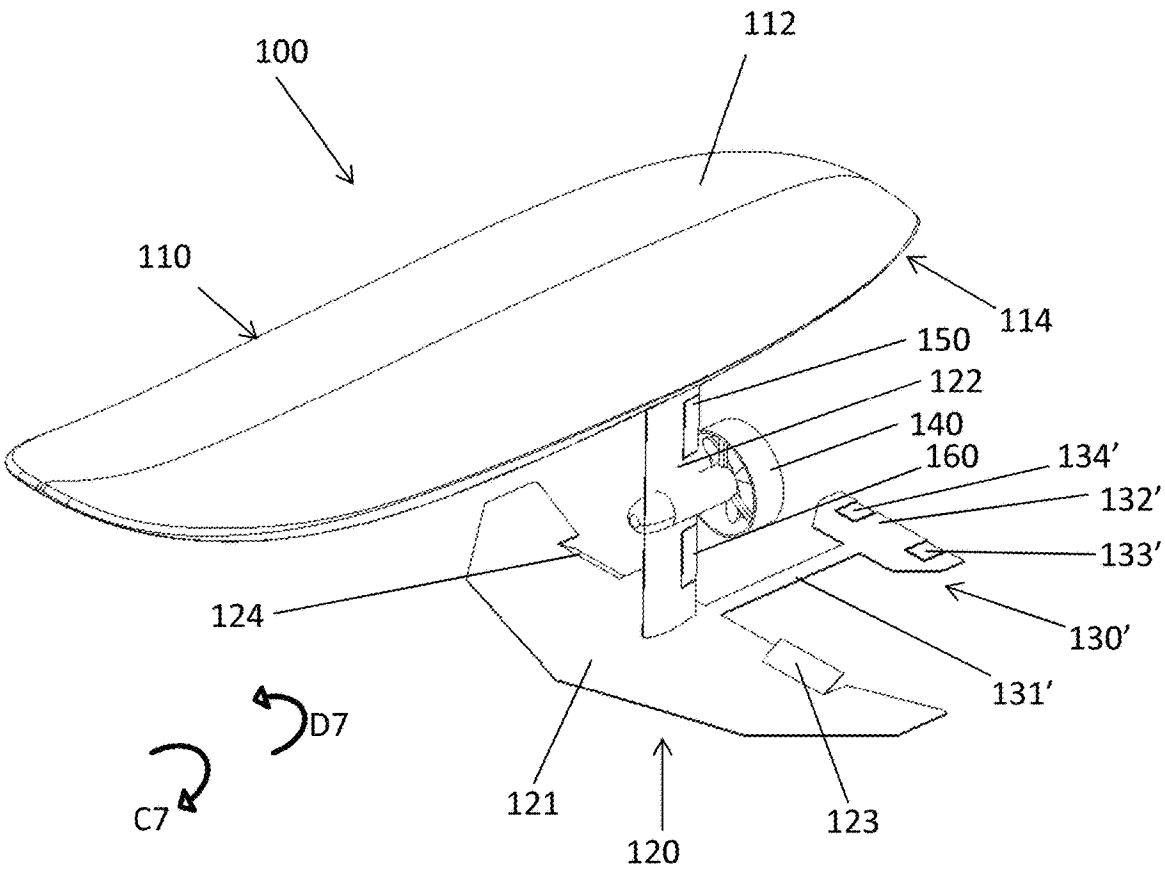
FIG. 9 illustrates a schematic view of another aspect of the motorized hydrofoil device to generate a corrective movement C7 to eliminate the effect of the deviation D7.

In addition to the second hydrofoil assembly 130', the first hydrofoil assembly 120 can also generate corrective movement to eliminate deviation of the hydrofoil device 100 around its longitudinal axis as discussed above. For example, as shown in FIG. 9, when the sensing unit 150 detects a deviation D7 that may cause the hydrofoil device 100 to roll in a counterclockwise manner, a deviation signal can be transmitted to the control unit 160 to trigger the first actuating units (123, 124) to make appropriate corrective movement C7 to stabilize the hydrofoil device 100.

As discussed above, the first actuating units (123, 124) are hingedly located on both sides of the first hydrofoil 121 and each of the first actuating units 123 and 124 can move up or down to control the movement of hydrofoil device 100 around its longitudinal axis. More specifically, when the control unit 160 receives the deviation signal regarding deviation D7 from the sensing unit, the actuating unit 123 is triggered to move up while the actuating unit 124 is moving down to generate a corrective clockwise torque with the corrective movement C7 to eliminate the effect generated by counterclockwise deviation D7 to further stabilize the hydrofoil 100.

Figure 10:
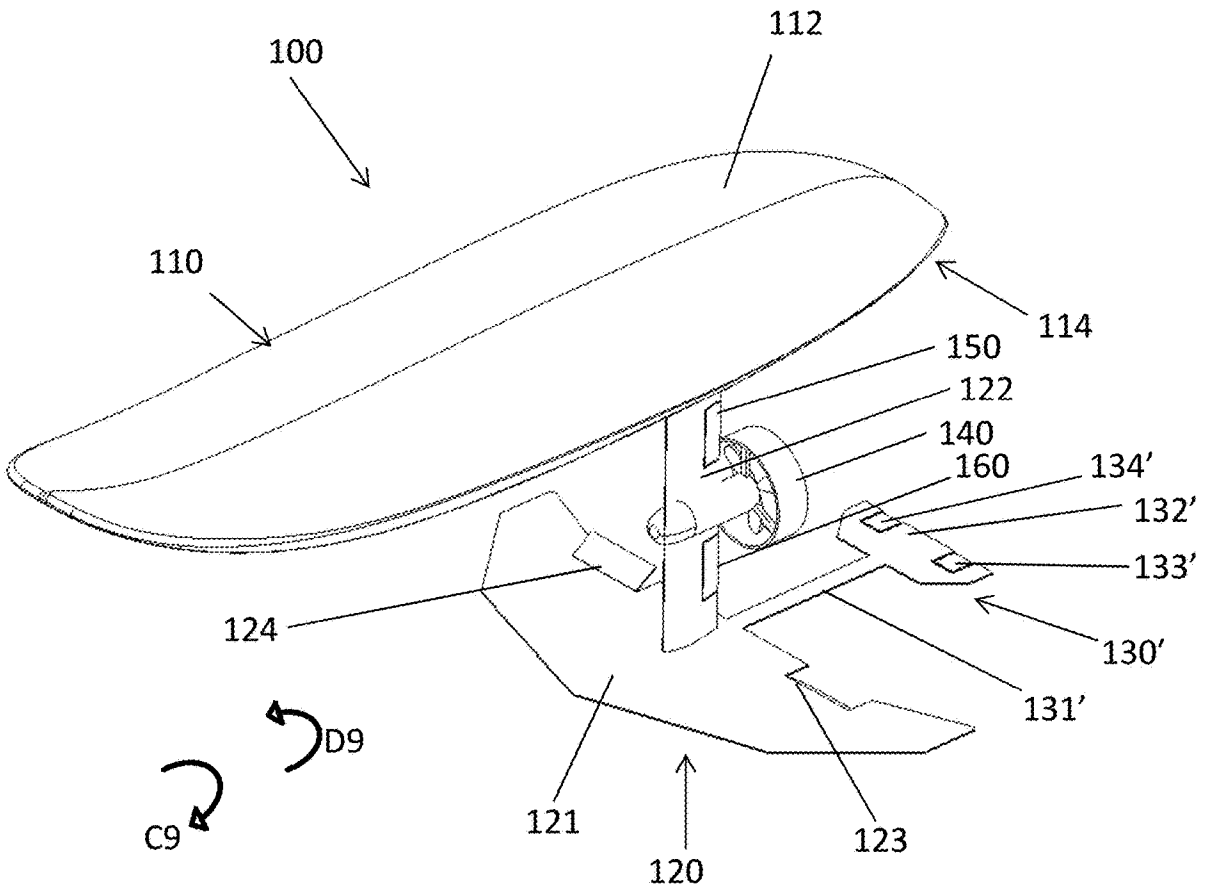
FIG. 10 illustrates a schematic view of another aspect of the motorized hydrofoil device to generate a corrective movement C8 to eliminate the effect of the deviation D8.

Likewise, as shown in FIG. 10, when the sensing unit 150 detects a deviation D8 that may cause the hydrofoil device 100 to roll in a clockwise manner, another deviation signal can be transmitted to the control unit 160 to trigger the first actuating units (123, 124) to make appropriate corrective movement C8 to stabilize the hydrofoil device 100. More specifically, when the control unit 160 receives the deviation signal regarding deviation D8 from the sensing unit, the actuating unit 123 is triggered to move down while the actuating unit 124 is moving up to generate a corrective counterclockwise torque with the corrective movement C8 to eliminate the effect generated by clockwise deviation D8 to further stabilize the hydrofoil 100.

In a further aspect, as shown in FIGS. 11 to 14, a hydrofoil device 100 may include a sailboard 110 having a top surface 112 and a bottom surface 114; a first hydrofoil assembly 120' having a first hydrofoil 121' and a first support unit 122'; and a propulsion system 140. In one embodiment, one end of the first support unit 121' is attached to a predetermined location at the bottom surface 114' of the sailboard 110 between a centre portion and a rear end of the sailboard 110; and the other end of the first support unit 122' is attached to nearly a centre portion of the first hydrofoil 121'. The propulsion system 140 is configured to provide power for the hydrofoil device 100. In one embodiment, the propulsion system 140 is disposed between the first actuating units (123', 124') discussed below. In a further embodiment, the hydrofoil device 100 may include one or more sensing units 150 disposed on predetermined locations on first supporting unit 122' of the first hydrofoil assembly 120'.

Figure 11:
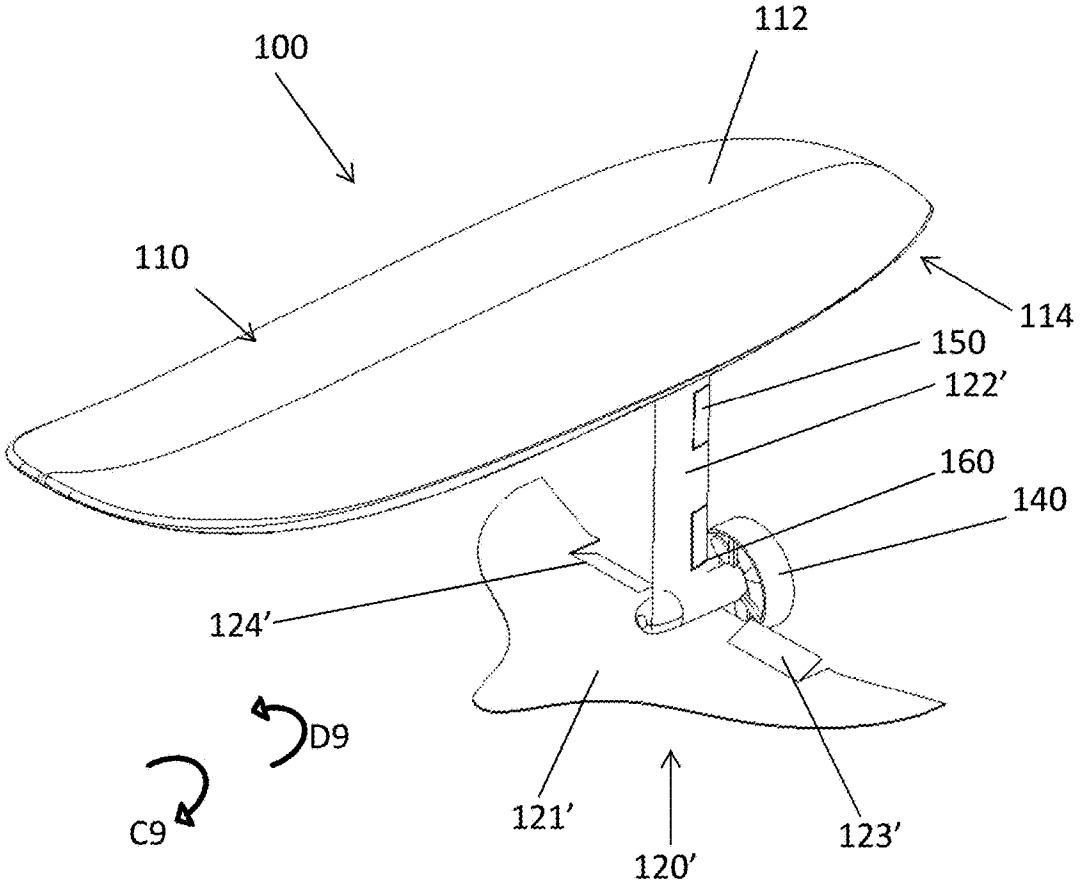
FIG. 11 illustrates a schematic view of a further aspect of the motorized hydrofoil device to generate a corrective movement C9 to eliminate the effect of the deviation D9.

In an exemplary embodiment, the first hydrofoil assembly 120' has a pair of first actuating units (123', 124') hingedly located on a trailing edge on both sides of the first hydrofoil 121', which are configured to stabilize the hydrofoil device 100 around its longitudinal axis, or roll axis. The first actuating units (123', 124') may operatively communicate with the sensing unit 150, so when a deviation of the hydrofoil device 100 around its longitudinal axis is detected by the sensing unit 150, a deviation signal will be transmitted to the control unit 160 to trigger first actuating units (123', 124') to correct the deviation. For example, as shown in FIG. 11, when the sensing unit 150 detects a deviation D9 that may cause the hydrofoil device 100 to roll in a counterclockwise manner, a deviation signal can be transmitted to the control unit 160 to trigger the first actuating units (123', 124') to make appropriate corrective movement C9 to stabilize the hydrofoil device 100.

More specifically, when the first actuating units 123' and 124' receive the deviation signal regarding deviation D9 from the sensing unit, actuating unit 123' is configured to move up while the actuating unit 124' is moving down to generate a corrective clockwise torque with the corrective movement C9 to eliminate the effect generated by counterclockwise deviation D9 to further stabilize the hydrofoil 100.

Figure 12:
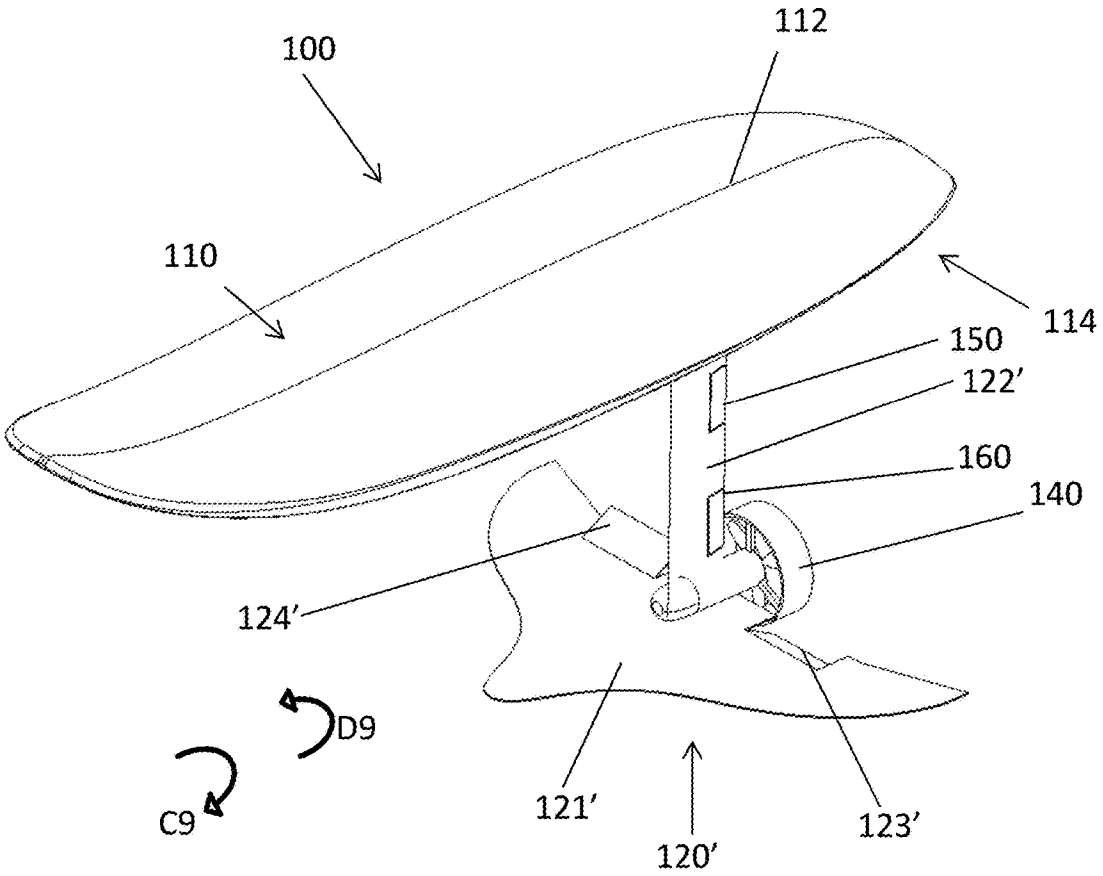
FIG. 12 illustrates a schematic view of a further aspect of the motorized hydrofoil device to generate a corrective movement C10 to eliminate the effect of the deviation D10.

Likewise, as shown in FIG. 12, when the sensing unit 150 detects a deviation D10 that may cause the hydrofoil device 100 to roll in a clockwise manner, another deviation signal can be transmitted to the control unit 160 to trigger the first actuating units (123', 124') to make appropriate corrective movement C10 to stabilize the hydrofoil device 100. More specifically, when the control unit 160 receives the deviation signal regarding deviation D10 from the sensing unit, the actuating unit 123' is triggered to move down while the actuating unit 124' is moving up to generate a corrective counterclockwise torque with the corrective movement C10 to eliminate the effect generated by clockwise deviation D10 to further stabilize the hydrofoil 100.

In addition to generating corrective movement around the longitudinal axis of the hydrofoil device 100, the first hydrofoil assembly 120' can also generate corrective movement to eliminate deviation of the hydrofoil device 100 around its lateral axis. Similar to elevators hingedly located on both sides of the tailplane to control the airplane's pitch, namely increasing or decreasing the lift generated by the wings when it pitches the airplane's nose up or down by increasing or decreasing the angle of attack, the first actuating units (123', 124') of the first hydrofoil assembly 120' are also configured to stabilize the hydrofoil device 100 around its lateral axis, or pitch axis.

Figure 13:
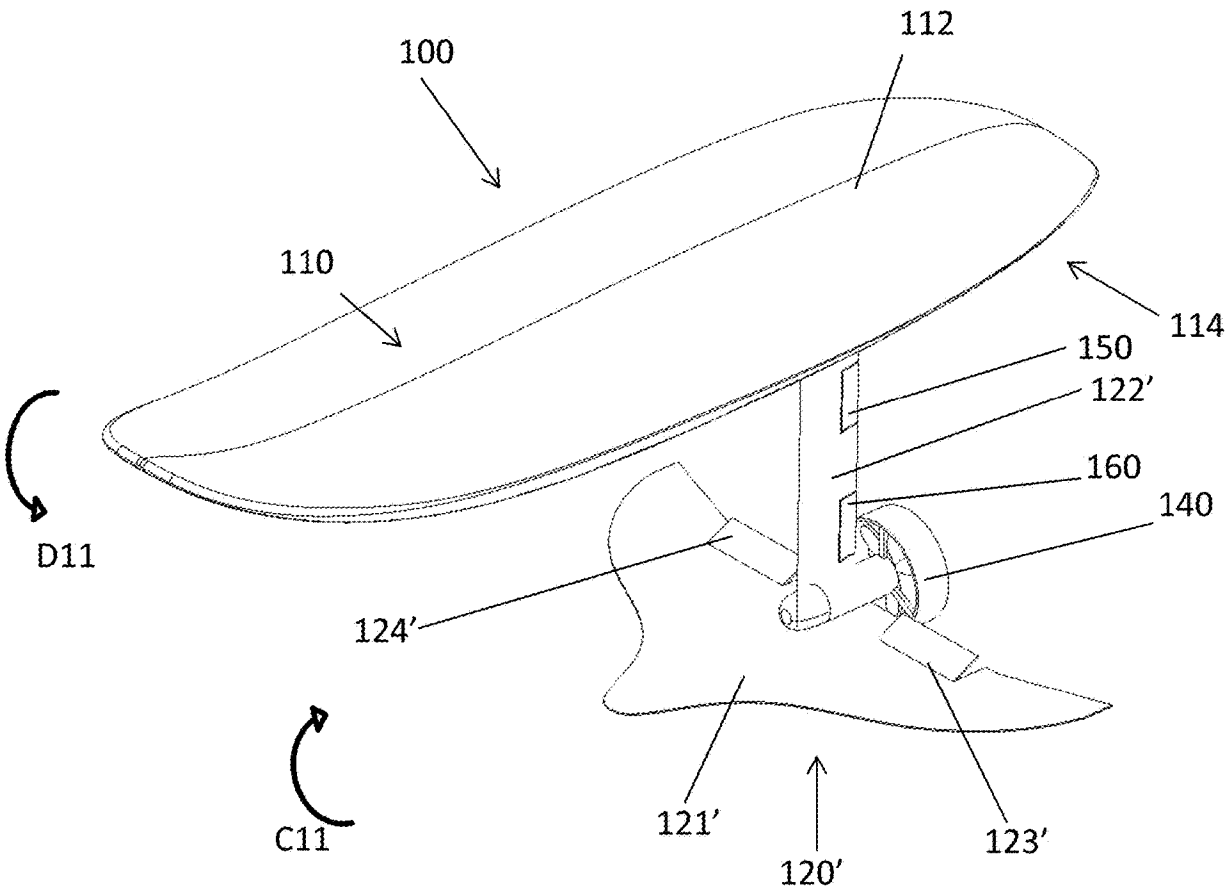
FIG. 13 illustrates a schematic view of a further aspect of the motorized hydrofoil device to generate a corrective movement C11 to eliminate the effect of the deviation D11.

In one embodiment, when a deviation of the hydrofoil device 100 around its lateral axis is detected by the sensing unit 150, a deviation signal will be transmitted to the control unit 160 to trigger the first actuating units (123', 124') to correct the deviation. For example, as shown in FIG. 13, when the sensing unit 150 detects a deviation D11 that may cause the hydrofoil device 100 to pitch down from the front end thereof, a deviation signal can be transmitted to the control unit 160 to trigger the first actuating units (123', 124') to make appropriate corrective movement C11 to stabilize the hydrofoil device 100. More specifically, both the first actuating units 123' and 124' are triggered to move up to generate a corrective torque with the corrective movement C11 to eliminate the effect of deviation D11 to further stabilize the hydrofoil 100.

Figure 14:
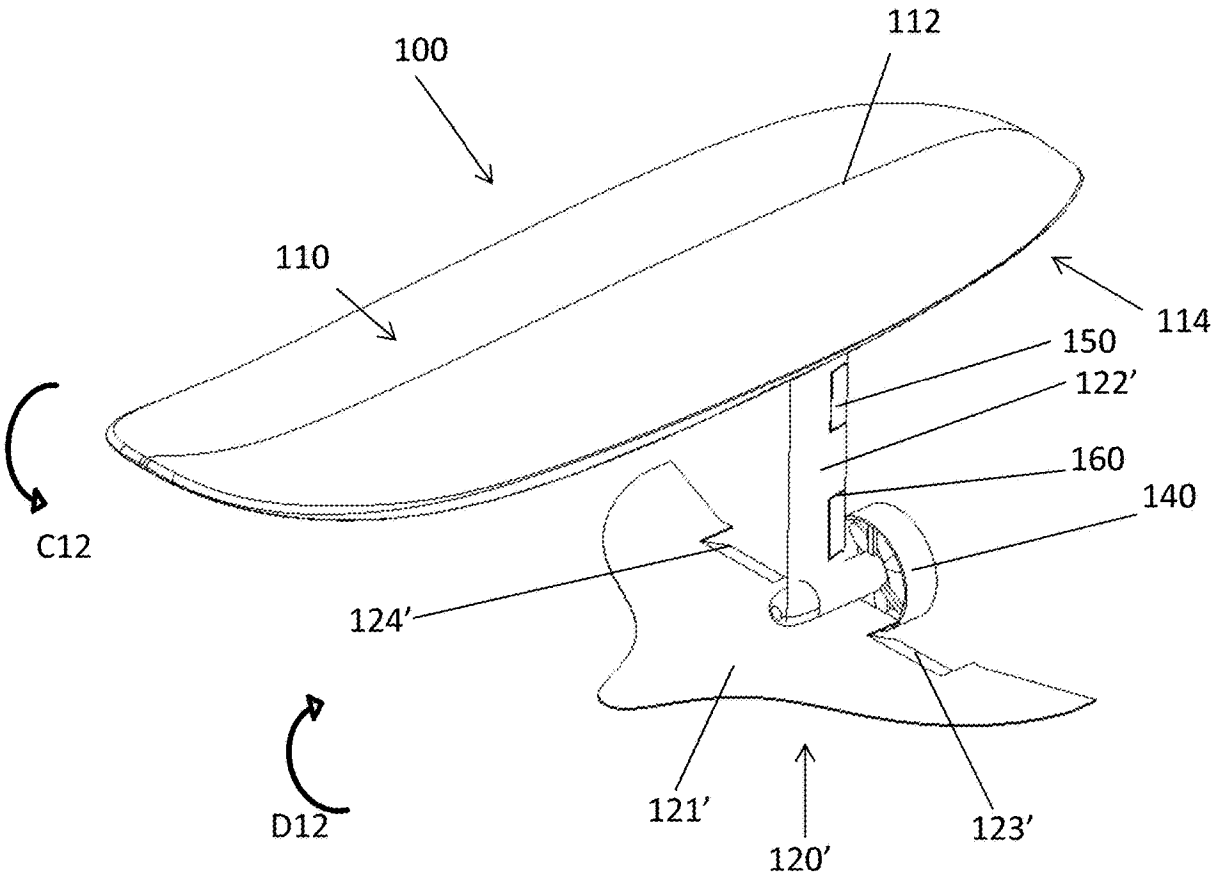
FIG. 14 illustrates a schematic view of a further aspect of the motorized hydrofoil device to generate a corrective movement C12 to eliminate the effect of the deviation D12.

Likewise, as shown in FIG. 14, when the sensing unit 150 detects a deviation D12 that may cause the hydrofoil device 100 to pitch up from the front end thereof, another deviation signal can be transmitted to the control unit 160 to trigger the first actuating units (123', 124') to make appropriate corrective movement C12 to stabilize the hydrofoil device 100. More specifically, both the first actuating units 123' and 124' are triggered by the control unit 160 to move down to generate a corrective torque with the corrective movement C12 to eliminate the effect generated by clockwise deviation D12 to further stabilize the hydrofoil 100.

Figure 15:
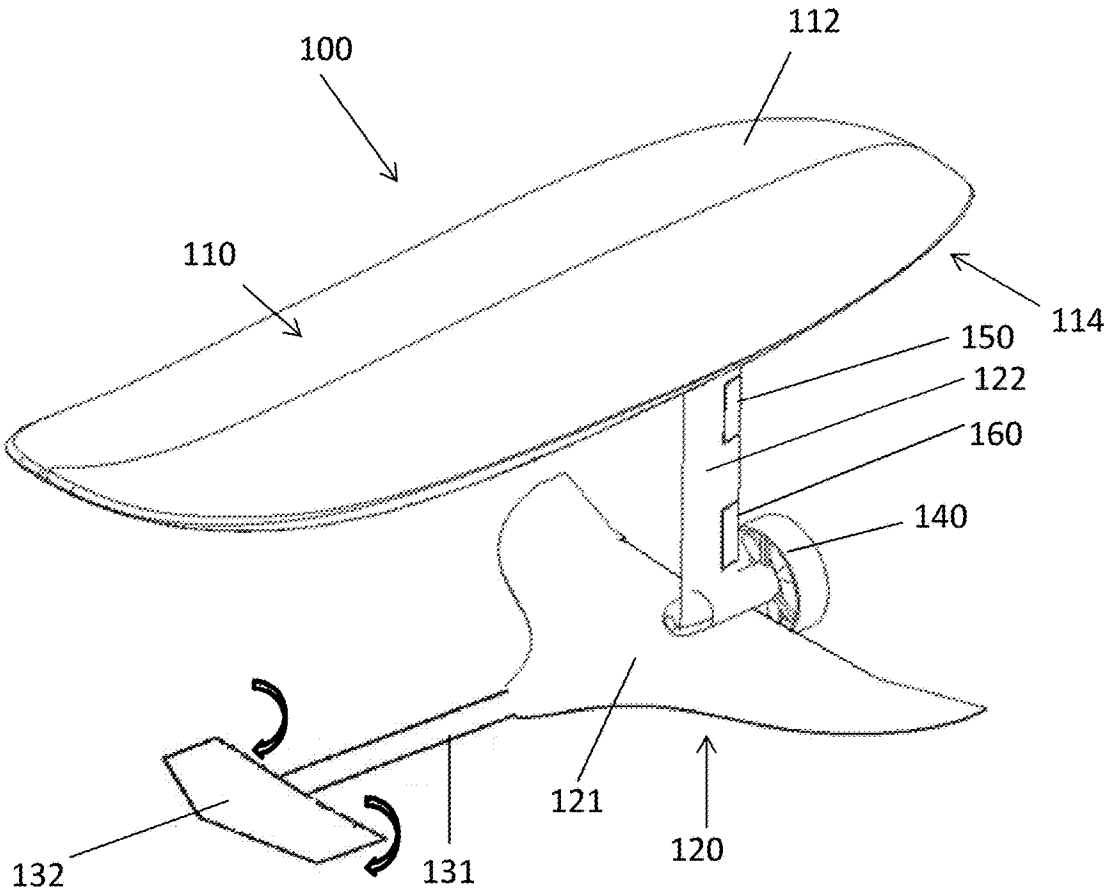
FIG. 15 illustrates a perspective view of a further aspect of the motorized hydrofoil device having no actuating units and having a movable second hydrofoil to generate a corrective movement in the pitch of the sailboard.

As shown in FIG. 15, it is also contemplated that the entire second hydrofoil 132 can pivot instead of using actuating units (123, 124, 133, 134). In one embodiment, there are no actuating units (123, 124, 133, 134) on the first and the second hydrofoils (120, 132). The hydrofoil 132 can hingedly attach to the second support unit 131, and can be controlled and triggered similar to how actuating units (123, 124, 133, 134) are controlled and triggered in other embodiments. Here, the second hydrofoil 132' is located in front of the first hydrofoil 121. In some embodiments, it is contemplated that the pitch of the sailboard is automatically controlled to remain level such that the sailboard is not excessively tilted forward or backward. In the embodiment shown in FIG. 15, the roll of the sailboard is not automatically controlled and the user would have to shift his or her weight to control the roll of the sailboard. In a further embodiment, only the pitch is automatically controlled.

Figure 16:
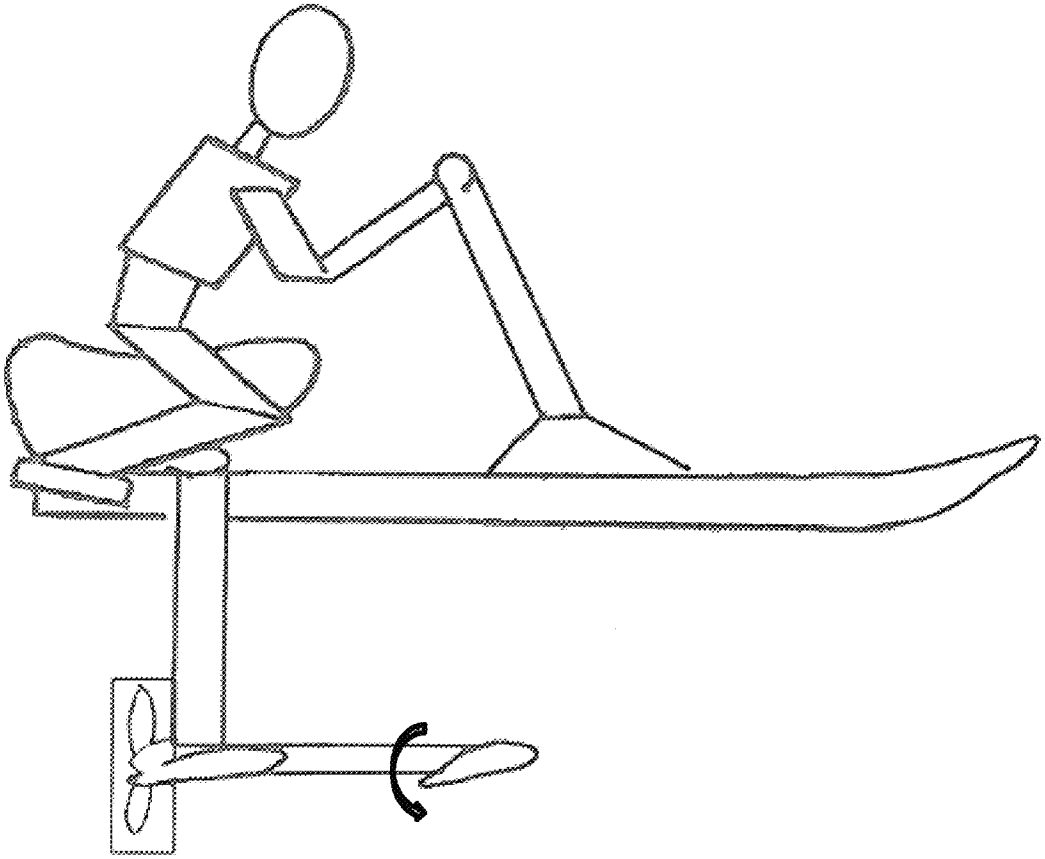
FIG. 16 illustrates a side view of another aspect of the motorized hydrofoil device having no actuating units and having a movable second hydrofoil to generate a corrective movement in the pitch of the sailboard.

FIG. 16 is a side view of one embodiment showing a pivoting second hydrofoil similar to that described in FIG. 15.

Figure 17:
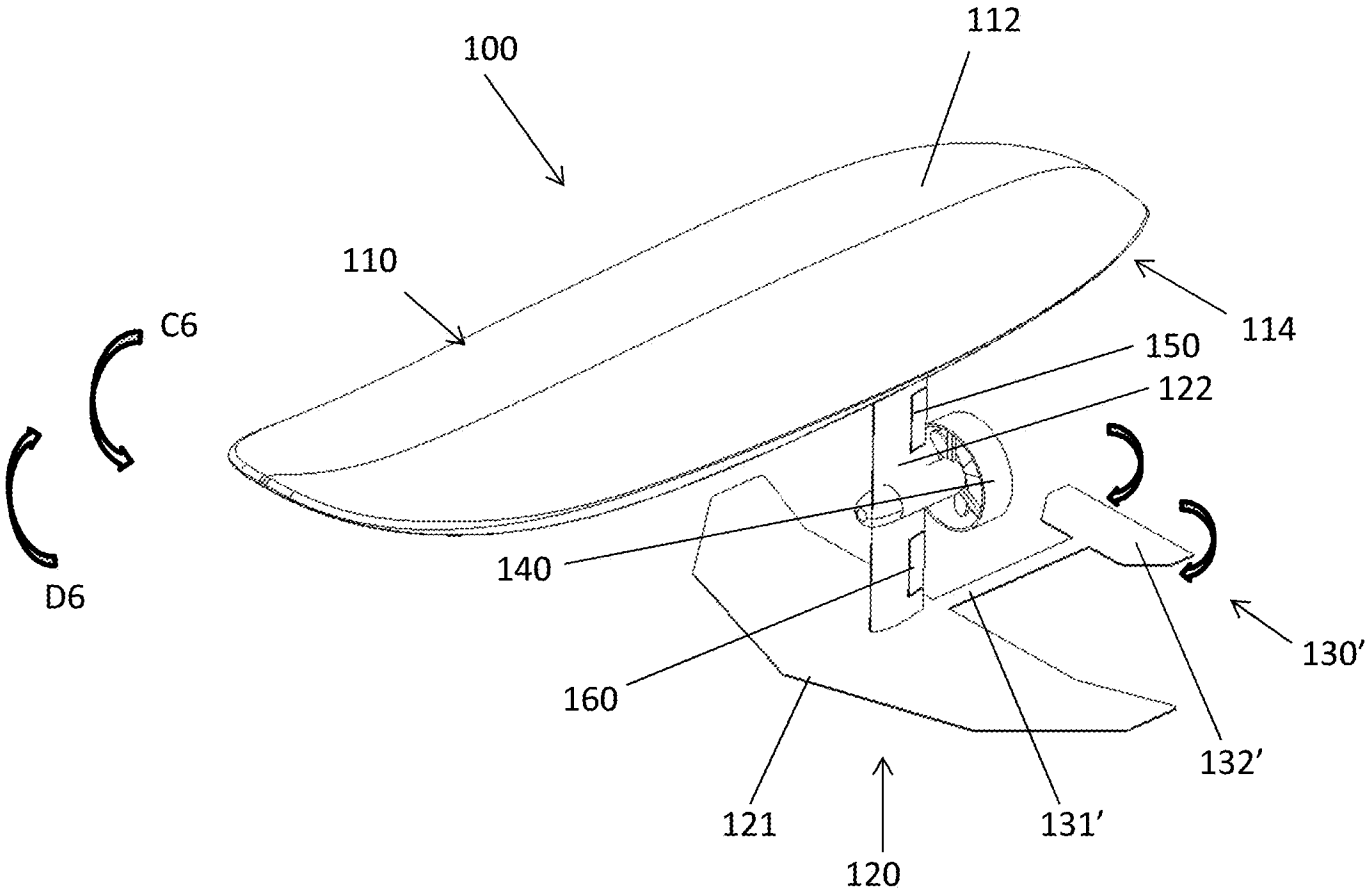
FIG. 17 illustrates a perspective view of a further embodiment of the motorized hydrofoil device having no actuating units and having a movable second hydrofoil to generate a corrective movement in the pitch of the sailboard.

Referring now to FIG. 17, the entire second hydrofoil 132' can pivot (see arrows) relative to the second support unit 131', thereby adjusting the pitch of the sailboard 110. Here, the second hydrofoil 132' is located behind the first hydrofoil 121.

Figure 18:
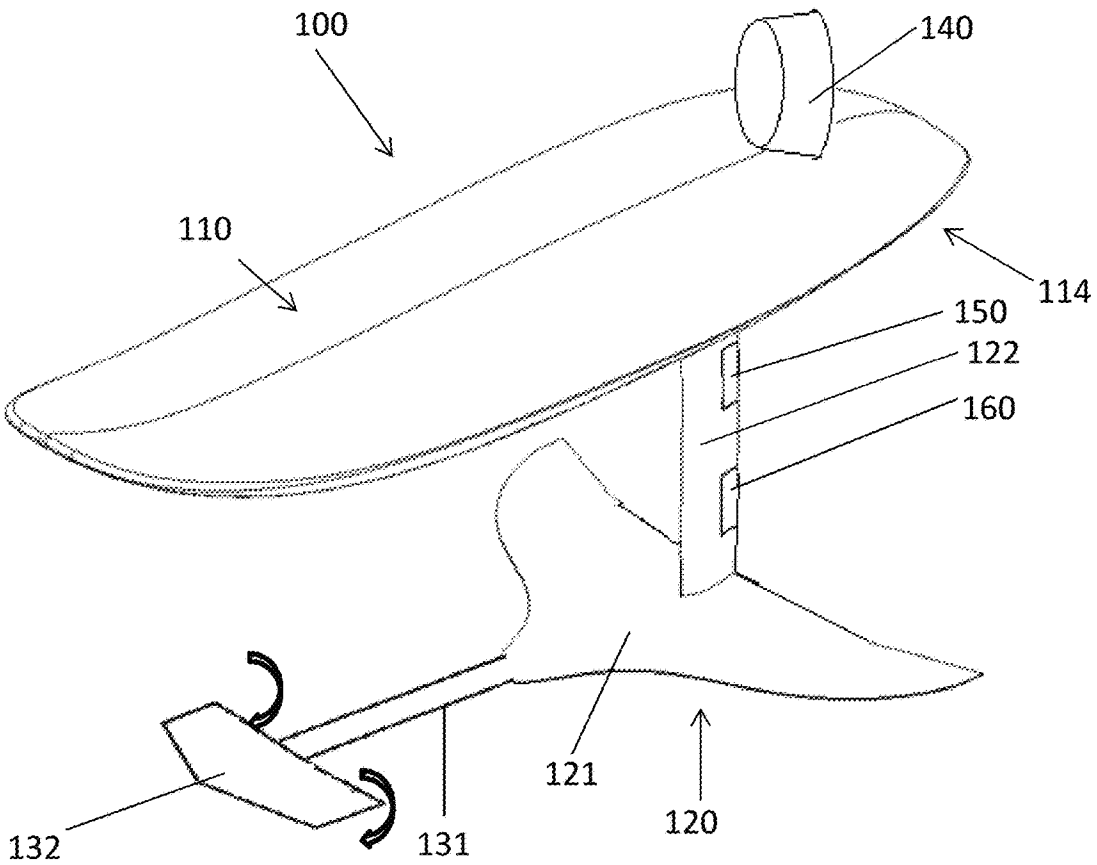
FIG. 18 illustrates a perspective view of a further aspect of the motorized hydrofoil device having a propulsion system on the top surface of the sailboard.

In a further contemplated embodiment, the propulsion system can be located not under water, but above the water line. As shown in FIG. 18, the propulsion system 140 can be coupled to the top side of the sailboard 110. Similarly, the propulsion system 140 can be electric and can be powered by a battery pack (not shown). This contemplated location of the propulsion system may be implemented in any of the above-disclosed embodiments. By placing the propulsion system 140 above the water line, the propulsion system 140 is less likely to be entangled with seaweed or other debris in the water.

Having described the invention by the description and illustrations above, it should be understood that these are exemplary of the invention and are not to be considered as limiting. Accordingly, the invention is not to be considered as limited by the foregoing description, but includes any equivalent.

What is claimed is:

1. A motorized hydrofoil apparatus comprising:

a sailboard having a top surface and a bottom surface;

a first hydrofoil assembly coupled to the sailboard, said assembly having a first hydrofoil, a first support unit coupling said sailboard to said first hydrofoil, and a second hydrofoil hingedly coupled to the first hydrofoil via a second support unit;

a propulsion system coupled to the sailboard to provide power to the hydrofoil apparatus;

a sensing unit to detect deviation movement of the hydrofoil apparatus; and a control unit to control the second hydrofoil to generate corrective movements to increase stability of the hydrofoil apparatus.

2. The motorized hydrofoil apparatus of claim 1, wherein when the sensing unit detects a pitch deviation movement that may cause the hydrofoil apparatus to tilt in either a forward or a backward manner, the control unit is configured to respond to the pitch deviation movement by triggering the second hydrofoil to make an appropriate corrective pivoting movement to stabilize the hydrofoil apparatus.

3. The motorized hydrofoil apparatus of claim 2, wherein the second support unit extends from a front end of the first hydrofoil, and said second hydrofoil is disposed ahead of the first hydrofoil.

4. The motorized hydrofoil apparatus of claim 3, wherein the entire second hydrofoil pivots relative to the second support unit.

5. The motorized hydrofoil apparatus of claim 4, wherein the second hydrofoil has no aileron and has no flaps.

6. The motorized hydrofoil apparatus of claim 4, wherein the propulsion system is electric and is disposed on the top surface of the sailboard.

7. The motorized hydrofoil apparatus of claim 4, wherein the propulsion system is electric and is disposed below the bottom surface of the sailboard.

8. The motorized hydrofoil apparatus of claim 2, wherein the second support unit extends from a rear end of the first hydrofoil, and said second hydrofoil is disposed behind the first hydrofoil.

9. The motorized hydrofoil apparatus of claim 8, wherein the entire second hydrofoil pivots relative to the second support unit.

10. The motorized hydrofoil apparatus of claim 9, wherein the second hydrofoil has no aileron and has no flaps.

11. The motorized hydrofoil apparatus of claim 9, wherein the propulsion system is electric and is disposed on the top surface of the sailboard.

12. The motorized hydrofoil apparatus of claim 9, wherein the propulsion system is electric and is disposed below the bottom surface of the sailboard.

13. The motorized hydrofoil apparatus of claim 2, wherein the first hydrofoil has a wider wingspan than the second hydrofoil.

14. The motorized hydrofoil apparatus of claim 13, wherein one end of the first support unit is attached to a predetermined location at the bottom surface of the sailboard between a center portion and a rear end of the sailboard; and the other end of the first support unit is attached to nearly a center portion of the first hydrofoil.

* * * * *